United States Patent [19]

Bergvall

[11] Patent Number: 4,651,664

[45] Date of Patent: Mar. 24, 1987

[54] ELECTRONIC SEWING MACHINE

[75] Inventor: Bengt A. Bergvall, Huskvarna, Sweden

[73] Assignee: Husqvarna Aktiebolag, Husqvarna, Sweden

[21] Appl. No.: 712,781

[22] Filed: Mar. 18, 1985

[30] Foreign Application Priority Data

Mar. 30, 1984 [SE] Sweden ..... 8401775

[51] Int. Cl.[4] ..... D05B 3/02

[52] U.S. Cl. ..... 112/458; 112/121.11; 112/272

[58] Field of Search ..... 112/458, 456, 453, 445, 112/272, 121.11, 121.12

[56] References Cited

U.S. PATENT DOCUMENTS

| | | | |
|---|---|---|---|
| 4,292,905 | 10/1981 | Widmer | 112/121.11 |
| 4,363,281 | 12/1982 | Reinke | 112/272 X |
| 4,370,938 | 2/1983 | Bergvall | 112/458 |
| 4,422,394 | 12/1983 | Bergvall | 112/458 X |

*Primary Examiner*—Peter Nerbun

*Attorney, Agent, or Firm*—Alfred E. Miller

[57] ABSTRACT

An electronic sewing machine has an input selector for the adjustment of input data to the machine. As a complement to the pattern selecting buttons, a cloth meter is provided and positioned at or on the machine. The button and meter provide data of a specific seam selection to the electronic systems on the machine. The cloth meter is used for making a selection of a seam from a series of seams which can be selected by the buttons. When the operator pushes a button, signals are composed to a seam selection code which is fed to a start address memory.

9 Claims, 2 Drawing Figures

ELECTRONIC SEWING MACHINE

The present invention relates to an arrangement for a sewing machines for making a seam selection in dependence of the properties of the sewing material. The machine has a built-in sewing guide and is provided with pattern selection means and an electronic seam memory providing stitch data to the stitch forming instrumentalities of the machine.

Electronic pattern sewing machines in general have an input selector in the form of a set of push buttons associated with a row of symbols or the like showing the seam the machine will sew when a button associated with a specific symbol is actuated. In simpler embodiments of the input selector the operator may be in doubt as to what seam is the best choice in the actual case. In more sophisticated input selectors a system is built-in in the electronic system with the purpose of facilitating the seam selection and making it uniform for one and the same kind of cloth. A system like this is described in the Swedish patent specification No. SE-PS 419,685 wherein the operator already has information about the cloth and the text and symbols on the machine and applies the input information directly to the machine. Based upon this information the data system selects the seam or seams which are most suitable for the cloth properties stated by the operator. However, the choice between the several symbols and eventually other controls must be made by the operator and for some materials it may be difficult to estimate the thickness and the texture. It is therefore desirable to have an instrument for determining these properties so that a uniform value for the material is obtained. This invention therefore provides a system for transferring and converting measured values directly to the data system so that the operator does not have to adjust the control for cloth properties etc.

Figure 1:
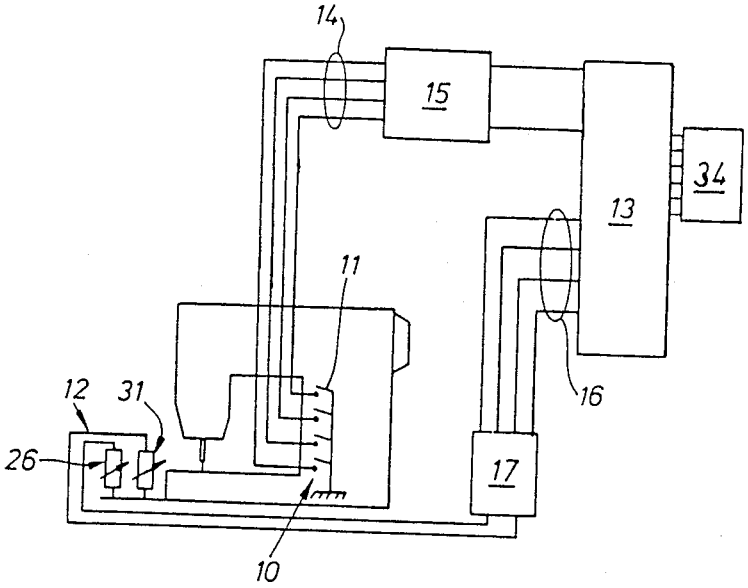
Figure 2:
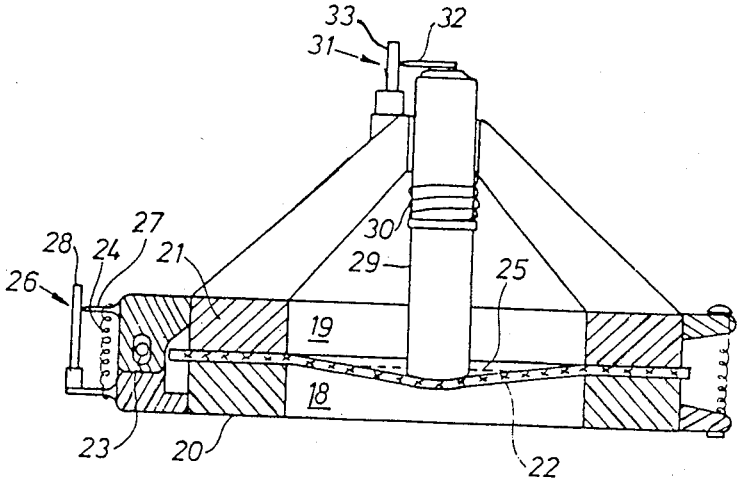

An embodiment of the invention will be described in the following with reference to the attached drawing in which FIG. 1 shows a wiring diagram of an electronic system of an input selector of a sewing machine and FIG. 2 shows a measuring instrument in a cross section view.

The drawing shows schematically a sewing machine with a panel 10 having buttons 11 for the adjustment of input data to the machine. As a complement to the buttons on the panel a cloth meter 12 is provided which is located on or at the machine. These controls 11, 12 are used for informing the electronic system of the machine of a certain seam selection. The cloth meter is used for the selection of a seam from a series of seams which can be selected by the buttons 11. When the operator pushes a button, signals are composed to a seam selection code which is supplied to a start address memory 13.

When the operator actuates a button 11 one of the inputs 14 of an encoder 15 is grounded and a unique three-bit code is fed to the start address memory 13. The latter has also a couple of two-bit inputs 16 from a converter 17 which inputs together with the three-bit code provide the input information. The cloth meter 12 is schematically connected to the converter 17 in FIG. 1, which multiplies the number of possible combinations. By means of e.g. four different pre-adjustments for elasticity and three for cloth thickness $4\times3=12$ different series of seams are obtained on the buttons 11. By means of text and symbols on the panel it is possible to assign the parameter of "sewing operation" to the buttons 11 and the parameter of "elasticity" and the parameter of "thickness" to the cloth meter 12. The operator starts by adjusting the cloth meter 12 according to the cloth to be sewn and finishes by selecting a button. The input information releases a start address word in the start address memory, which word is determined by these parameters and constitutes the first step of a data process in a series of different function blocks which form the data system of the machine. There is no need for describing this process here but reference is made to known systems, e.g. the system described in the aforesaid patent specification SE-PS No. 419,658.

The device shown in FIG. 2 is a preferred embodiment of a measure apparatus for cloth elasticity and cloth thickness. It is mainly composed of a bottom portion 18 and a top portion 19. In each portion is a ring 20,21 and in the shown position these rings are concentric and separated by a layer of cloth 22. The portions are joined by a hinge 23 so that the top portion can be swung upwards thus making place for the cloth which is laid on the lower ring 20. The top portion is then swung back and pressed to the bottom portion by means of springs 24. The cloth thickness is then measured as the distance 25 between the rings 20,21 which distance is registered by a potentiometer 26 which has a movable contact 27 moving together with the upper ring and sliding on a resistor 28 creating a resistance proportional to the distance 25. The other parameter, "elasticity", is measured by means of a central pin 29 which is slidably journalled in the top portion and biassed longitudinally downwards by a helical spring 30. The declination of the cloth is the center, when it is fastened between the rings, is a value of the elasticity. It is measured by a second potentiometer 31, which has a slide contact 32 connected to the pin and a resistor 33 mounted on the top portion. In order to obtain a uniform pressure on the cloth between the two rings the tension springs 24 act between the bottom portion 18 and the top portion 19 and they can easily be loosened when the cloth is to be removed and be put on again when measuring is to be done. The resistances of the potentiometers 26, 31 are each converted in the analog-digital converter 17 into a two-bit digital code.

Among other adjustments of the machine to be carried out before the start of sewing and which are dependent on the "cloth parameters" presser foot pressure, needle size and thread thickness can be mentioned. These values are usually determined empirically after careful tests and are revealed to the operator by a special instruction. Since the seam selection is now decided in the form of a start address from the start address memory it is possible to store and indicate such an instruction directly after a complete seam selection whereby the start address is used as an input code into a memory 34 storing this instruction. The output code is fed to converting and actuating circuits for indication means on the panel of the machine. A system for such indication according to the converter adjustment etc. is described in the Swedish patent specification SE-PS No. 420,328. Besides showing an appropriate presser foot pressure, needle and thread such a system has capacity for recommendation of stitch length and stitch width which matters suitably are adjusted manually on separate controls. However, for certain seams the adjustment of stitch length and width can be made automatically when the seam is selected (i.e. on the buttons 11). The invention is well applicable to a system as described in the said patent specification in which there is also an indicator for the type of presser foot. Although well applicable to the systems described in the above-mentioned patents the invention shall not be considered to be restricted to these systems but to be a totally independent invention.

I claim:

1. In an electronic sewing machine having a stitch code memory means for generating stitch code signals for the sewing of a plurality of different seams, a start address memory means for selectively addressing starting addresses in said stitch code memory means for the selective sewing of said different seams, and input means coupled to said start address memory means for selecting an address thereof that corresponds to the starting address of a selective seam of said stitch code memory means; the improvement wherein said input means comprises cloth measuring first input means for measuring determined characteristics of a cloth to be sewn, for providing a first part of the input to said start address memory means and second input means comprising manually operable switch means for selecting series of seams, whereby said start address memory means provides a start address output for said stitch code memory means corresponding to a determined one of the selected series of seams as a function of the output of said measuring means.

2. The electronic sewing machine of claim 1 wherein said measuring means comprises means for measuring the thickness of said cloth.

3. The electronic sewing machine of claim 1 wherein said measuring means comprises means for measuring the elasticity of said cloth.

4. The electronic sewing machine of claim 1 wherein said measuring means comprises means for providing an output that is a function of both the elasticity and thickness of said cloth.

5. The electronic sewing machine of claim 1 wherein said second input means comprises manually operable push buttons on said sewing machine.

6. The electronic sewing machine of claim 1 wherein said sewing machine has a body, said measuring means being built into said sewing machine body.

7. The electronic sewing machine of claim 1 wherein said measuring means comprises a measuring device that is physically separate from and electrically connected to said sewing machine.

8. The electronic sewing machine of claim 1 wherein said cloth measuring means comprises means for producing analog signals corresponding to determined characteristics of said cloth, and analog to digital converting means for converting said analog signals to digital signals for application to said start address memory means.

9. The electronic sewing machine of claim 1 wherein said start address memory means comprises a memory having an address input of first and second groups, said first input means coupled to said first group and said second input means coupled to said second group, whereby the output of said start address memory means comprises the starting address in said stitch code memory means of a sequence of codes corresponding to a selected seam.

* * * * *